United States Patent [19]

Elkin

[11] Patent Number: 4,907,425

[45] Date of Patent: Mar. 13, 1990

[54] JEWELRY CLUTCH

[75] Inventor: Alfred A. Elkin, Pawtucket, R.I.

[73] Assignee: Plastic Development, Inc., Pawtucket, R.I.

[21] Appl. No.: 264,774

[22] Filed: Oct. 31, 1988

[51] Int. Cl.[4] ..... A44C 7/00

[52] U.S. Cl. ..... 63/12; 264/154; 264/250

[58] Field of Search ..... 24/617, 616, 621; 63/12, 20, DIG. 3; 264/154, 250

[56] References Cited

U.S. PATENT DOCUMENTS 3,945,089 3/1976 Gagnon ..... 24/705

*Primary Examiner*—James Lowe

*Attorney, Agent, or Firm*—Salter & Michaelson

[57] ABSTRACT

A method of forming a jewelry clutch includes the steps of molding an inner gripping piece from a substantially solid, elastomeric, thermoplastic material and forming a plastic outer casing having an opening at one end thereof around the gripping piece. The method further includes the step of inserting an elongated stud or post into the opening in the casing so that the post penetrates through the gripping piece to form a substantially resealable opening therein. The clutch formed by the method can be installed on the post or stud of a jewelry item so that the stud passes through the opening in the outer casing and is received in the resealable opening in the gripping piece to releasably retain the post in the clutch.

3 Claims, 1 Drawing Sheet

JEWELRY CLUTCH

BACKGROUND AND SUMMARY OF THE INVENTION

The instant invention relates to the jewelry art and more particularly to a jewelry clutch which is releasably securable on the post of a jewelry item, such as a pierced earring.

Various types of jewelry clutches have been heretofore available for gripping the posts or studs of jewelry items, such as pierced earrings. In this connection, the most common type of heretofore available jewelry clutch comprises an outer metallic casing having an aperture therethrough, and a rubberized gripping member in the casing which is operative for gripping the post of a jewelry item inserted through the aperture in the casing. However, it has been found that in some instances, the gripping members of devices of this type are less than entirely effective for securely gripping the posts of jewelry items and that, as a result, in some instances clutches of this type can inadvertently slip off the posts of jewelry items. Other types of jewelry clutches which represent the closest prior art to the subject invention of which the applicant is aware are disclosed in the U.S. patents to CHERNOW, U.S. Pat. No. 3,698,044; GAGNON, U.S. Pat. No. 3,945,089; CONNELLY et al, U.S. Pat. No. 4,630,452; and NITSCHE, U.S. Pat. No. 4,723,421. However, the clutches disclosed in these references have also been found to be prone to inadvertently slipping off the posts of jewelry items.

The instant invention provides a method of forming a jewelry clutch which is releasably securable on the post of a jewelry item, such as a pierced earring, with an increased level of effectiveness. Specifically, the method of the subject invention comprises the steps of molding a substantially solid inner gripping piece from an elastomeric, plastic material having a Shore A durometer of between 30 and 90, and forming an outer casing around the gripping piece, the outer casing having an opening therein, for receiving the post of a jewelry item therein. The gripping piece is formed so that it includes an elongated gripping axis which is aligned with the opening in the outer casing, and it is initially formed so that it is imperforate along at least a portion of the gripping axis thereof. The method further comprises the step of inserting an elongated stud having a diameter of less than approximately 0.045 in. into the opening in the outer casing so that it penetrates the imperforate portion of the gripping piece along the gripping axis thereof in order to provide an opening in the gripping piece which essentially reseals itself when the stud is removed. The outer casing is preferably molded around the gripping piece and it is preferably made from a substantially solid, plastic material having a Shore A durometer which is between 40 and 100 and which is at least 10 points greater than the Shore A durometer of the inner gripping piece. The outer casing preferably includes a substantially circular flange which is substantially perpendicular to the gripping axis, and the opening in the outer casing is preferably disposed in the center of the circular flange.

It has been found that the jewelry clutch of the instant invention has significant advantages over the heretofore available clutches. Specifically, it has been found that by forming the opening in the gripping piece by penetrating it with an elongated stud, the inner gripping piece is better able to effectively grasp the stud to retain the clutch thereon. Further, once the stud has been removed, the opening in the gripping piece is operative for resealing itself so that the gripping piece can again be utilized to grasp the same stud or another stud in a similar manner.

Accordingly, it is a primary object of the instant invention to provide an effective method of forming an improved jewelry clutch.

Another object of the instant invention is to provide a method of forming a jewelry clutch wherein a gripping piece is penetrated by an elongated stud in order to form an opening in the gripping piece for receiving the post or stud of a jewelry item.

An even further object of the instant invention is to provide an improved jewelry clutch including a gripping piece having an opening therein which is formed by penetrating the gripping piece with an elongated stud.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
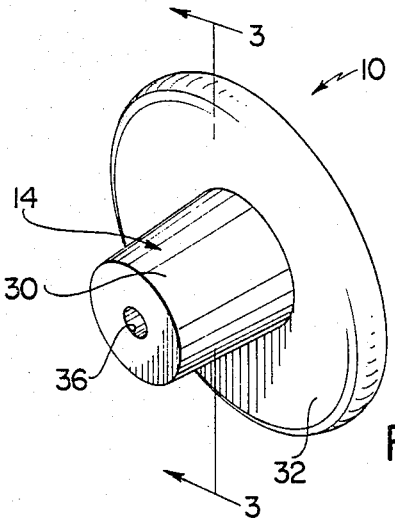
FIG. 1 is an enlarged, rear perspective view of the jewelry clutch of the instant invention.
Figure 2:
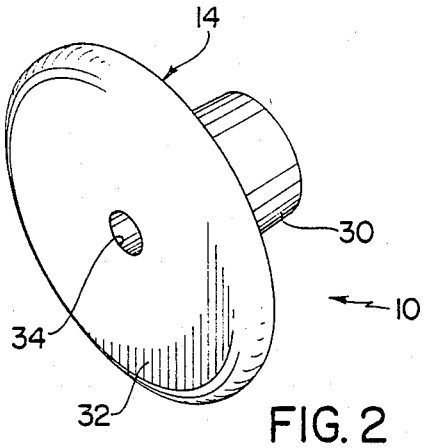
FIG. 2 is an enlarged, front perspective view thereof.

Referring now to the drawings, the jewelry clutch of the instant invention is illustrated in FIGS. 1–6 and generally indicated at 10. The clutch 10 comprises an inner gripping piece generally indicated at 12, and an outer casing generally indicated at 14, and it is adapted to be releasably secured on the post or stud 16 of a jewelry item by inserting the stud 16 into the clutch 10 so that it passes through the inner gripping piece 12.

Figure 4:
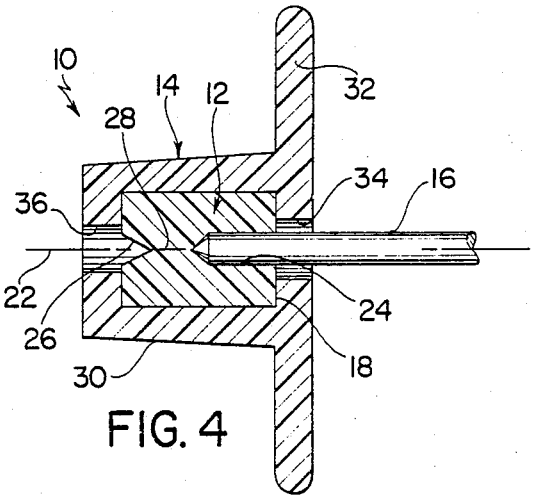
FIGS. 4 and 5 are sequential views illustrating the insertion of a stud into the clutch.
Figure 5:
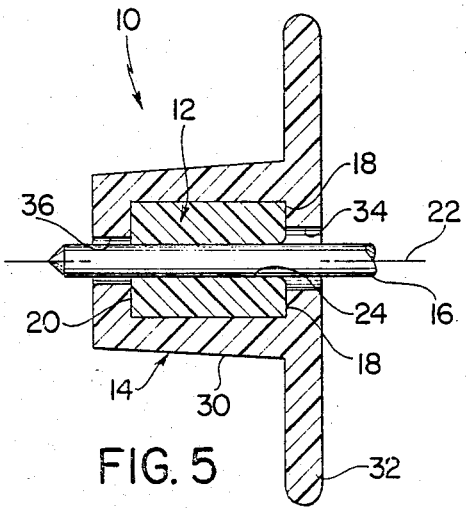
Figure 6:
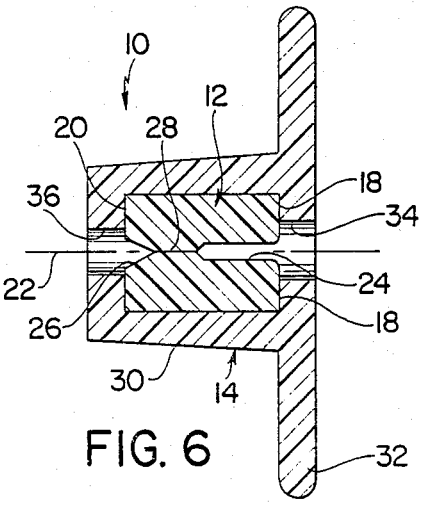
FIG. 6 is a sectional view of the clutch after removing the stud.

The inner gripping piece 12 is preferably made from a suitable, substantially solid, elastomeric, thermoplastic rubber material, such as ALCRYN (DuPont TM) having a Shore A durometer of between 30 and 90, in a substantially cylindrical configuration. The gripping piece 12 is preferably formed so that it has a first end 18, a second end 20 and a longitudinal gripping axis 22 which extends between the first and second ends 18 and 20, respectively. The gripping piece 12 preferably has an aperture 24 therein which extends inwardly a distance along the axis 22 from the first end 18, and a conical notch 26 which extends inwardly from the second end 20 along the axis 22. The gripping piece 12 is initially formed with an imperforate center portion 28 which is disposed between the aperture 24 and the notch 26 along the axis 22 as illustrated in FIGS. 3 and 4; although, as illustrated in FIGS. 5 and 6, the central portion 28 is thereafter penetrable by the post 16 when the post 16 is inserted into the clutch 10.

The outer casing 14 is preferably molded around the inner gripping piece 12, and it is made from a suitable olefin plastic or thermoplastic. The outer casing 14 preferably has a Shore A durometer of between 40 and 100, and it preferably has a durometer which is at least 10 points higher on the Shore A scale than the durometer of the material from which the inner gripping piece 12 is constructed. As a result, the outer casing 14 is operative for minimizing expansion of the inner gripping piece 12 when the post 16 is inserted into the clutch 10. The outer casing 14 comprises a cylindrical body portion 30, which is molded around the inner gripping piece 12, and a circular flange portion 32, which is substantially perpendicular to the gripping axis 22. The circular flange portion 32 has an aperture 34 therethrough which is substantially aligned with the gripping axis 22, and an aperture 36 is formed in the body portion 30, the aperture 36 being aligned with the conical notch 26 and the aperture 34. The clutch 10 is preferably dimensioned so that the circular flange portion 32 has a diameter of approximately ½ in., although other embodiments of the clutch 10 which are formed in other dimension or which do not include the flange portion 32 are contemplated.

Figure 3:
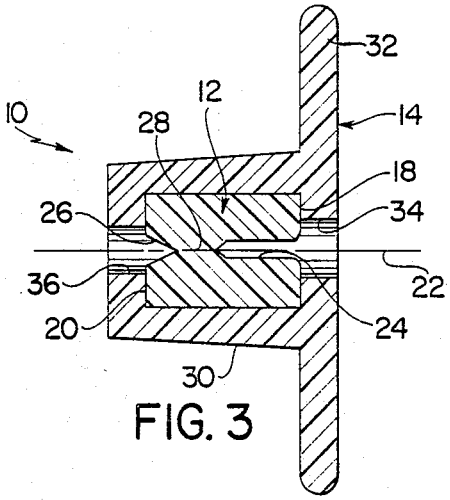
FIG. 3 is a sectional view taken along line 3—3 in FIG. 1.

During manufacture of the clutch 10, the gripping piece 12 is integrally molded from a suitable elastomeric, thermoplastic, rubberized material, and the outer casing 14 is integrally molded around the inner gripping piece 12 to form the clutch 10 as illustrated in FIG. 3. Thereafter, the central portion 28 of the gripping piece 12 is penetrated by a stud 16 in the manner illustrated in FIGS. 4 and 5. In this connection, the stud 16 preferably has a diameter of less than 0.045 in., and it is preferably at least slightly pointed. The stud 16 is inserted into the aperture 24 and forced through the central portion 28 as illustrated. The stud 16 may either comprise an elongated member which is utilized specifically for the purpose of puncturing or penetrating the central portion 28, or alternatively it may comprise the post of a jewelry item, such as an earring. In any case, the post 16 is inserted into the gripping piece 12 so that it passes through the central portion 28 to the position illustrated in FIG. 5. Thereafter, when the stud 16 is removed from the clutch 10, the elastomeric gripping piece 12 is effectively operative for resealing itself as illustrated in FIG. 6. Accordingly, when the stud 16 or another stud or post, such as the post of an earring, is inserted into the clutch 10, the gripping piece 12 can effectively grasp the post or stud 16 in the central portion 28 to retain the clutch 10 thereon.

It is seen therefore that the instant invention provides an effective jewelry clutch and method of making same. In this regard, because the gripping piece 12 is made of an elastomeric, thermoplastic material, and because the stud 16 is forced through the central portion 28 in order to penetrate the central portion 28, the gripping piece 12 can more effectively grasp the stud 16 or another stud or post to retain the clutch 10 thereon. Further, because the clutch 10 is molded from suitable plastic materials, it is adapted for a variety of relatively inexpensive constructions. Accordingly, for these reasons, it is seen that the clutch 10 represents a significant advancement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A jewelry clutch made by a method comprising the steps of molding a substantially solid inner gripping piece from an elastomeric, thermoplastic material having a Shore A durometer of between 30 and 90, said inner gripping piece having a gripping axis but initially being imperforate along at least a portion of said gripping axis, forming an outer casing around said inner gripping piece, said outer casing having an opening therein which is aligned with said gripping axis, and inserting an elongated stud into said opening so that it penetrates the initially imperforate portion of said gripping piece along said gripping axis, said stud having a diameter of less than approximately 0.045 in.

2. In the jewelry clutch of claim 1, said outer casing including a substantially circular flange which is substantially pependicular to said gripping axis, said opening passing through said flange.

3. In the jewelry clutch of claim 1, said step of forming an outer casing further characterized as molding an outer casing from a substantially solid plastic material around said inner gripping piece, said outer casing being molded from a plastic material having a Shore A durometer which is between 40 and 100 and which is at least 10 points greater than the Shore A durometer of said inner gripping piece.

* * * * *